US007458427B2

(12) United States Patent
Braun et al.

(10) Patent No.: US 7,458,427 B2
(45) Date of Patent: Dec. 2, 2008

(54) MIXING CHAMBER FOR PRODUCING COMPRESSED AIR FOAM FOR FIRE EXTINGUISHING DEVICES

(76) Inventors: Ulrich Braun, Hochweg 11c, 85055 Ingolstadt (DE); Helmut Andris, Mühlweg 3, 85080 Gaimersheim (DE)

( * ) Notice: Subject to any disclaimer, the term of this patent is extended or adjusted under 35 U.S.C. 154(b) by 602 days.

(21) Appl. No.: 10/204,985

(22) PCT Filed: Feb. 28, 2001

(86) PCT No.: PCT/DE01/00752

§ 371 (c)(1),
(2), (4) Date: Aug. 26, 2002

(87) PCT Pub. No.: WO01/64290

PCT Pub. Date: Sep. 7, 2001

(65) Prior Publication Data

US 2003/0010506 A1 Jan. 16, 2003

(30) Foreign Application Priority Data

Mar. 3, 2000 (DE) ..... 100 10 141

(51) Int. Cl.
*A62C 35/00* (2006.01)

(52) U.S. Cl. ..... 169/15; 169/5; 169/9; 169/24; 169/54; 239/311; 239/343; 239/346; 239/373; 239/419; 239/432; 239/433; 239/590.3; 239/369

(58) Field of Classification Search ..... 169/51–54, 169/62, 24, 26, 5, 27, 13–15, 19, 9, 85; 239/428.5, 239/427.5, 416.5, 417, 432, 310, 311, 142, 239/143, 343, 346, 369, 373, 419, 433, 590, 239/590.3; 261/76, DIG. 26
See application file for complete search history.

(56) References Cited

U.S. PATENT DOCUMENTS 2,213,122 A * 8/1940 Gohre ..... 261/DIG. 26
3,836,076 A * 9/1974 Conrad et al. ..... 169/15
3,918,647 A * 11/1975 Lamz et al. ..... 239/432
4,213,936 A * 7/1980 Lodrick ..... 239/432
4,420,047 A * 12/1983 Bruensicke ..... 169/53
4,588,510 A * 5/1986 Salyer et al. ..... 252/3

(Continued)

FOREIGN PATENT DOCUMENTS

DE PS 687 926 2/1940

(Continued)

OTHER PUBLICATIONS

"Motionless Mixers," Burlington Pump Inc. Pamphlet, Burlington, Ontario.

*Primary Examiner*—Steven J Ganey
(74) *Attorney, Agent, or Firm*—Lieberman & Brandsdorfer, LLC

(57) ABSTRACT

The invention relates to a mixing chamber for producing compressed air foam in fire extinguishing devices. The mixing chamber has a compressed air inlet, an extinguishing agent inlet and a compressed air foam outlet. The contour of the mixing chamber tapers towards the compressed air foam outlet. The invention also includes a fire extinguishing device. The fire extinguishing device includes an extinguishing agent container, a connecting device for connecting a source of compressed air to a mixing chamber of the kind described above.

13 Claims, 6 Drawing Sheets

U.S. PATENT DOCUMENTS

| | | | | | |
|---|---|---|---|---|---|
| 4,981,178 | A | * | 1/1991 | Bundy | 169/9 |
| 5,113,945 | A | * | 5/1992 | Cable | 169/15 |
| 5,255,747 | A | | 10/1993 | Teske et al. | |
| 5,427,181 | A | * | 6/1995 | Laskaris et al. | 169/14 |
| 5,881,817 | A | | 3/1999 | Mahrt | |
| 6,089,324 | A | * | 7/2000 | Mahrt | 169/15 |
| 6,138,994 | A | * | 10/2000 | Rowe | 169/14 |
| 6,223,827 | B1 | | 5/2001 | Zuev et al. | |

FOREIGN PATENT DOCUMENTS

| | | | |
|---|---|---|---|
| DE | 30 34 622 | A1 | 4/1982 |
| DE | 44 43 111 | | 6/1996 |
| DE | 195 20 265 | A1 | 12/1996 |
| DE | 296 20 743 | | 4/1997 |
| DE | 196 46 562 | | 5/1998 |
| EP | 0 170 234 | A2 | 2/1986 |
| EP | 0 841 078 | | 5/1998 |
| EP | 1 053 935 | A1 | 11/2000 |
| EP | 1 132 114 | | 9/2001 |
| EP | 1 132 115 | | 9/2001 |
| WO | WO 96/37260 | | 11/1996 |
| WO | WO 98/51374 | | 11/1998 |
| WO | WO 99/39977 | | 8/1999 |

* cited by examiner

MIXING CHAMBER FOR PRODUCING COMPRESSED AIR FOAM FOR FIRE EXTINGUISHING DEVICES

CROSS-RELATED APPLICATION

This application is a 35 U.S.C. §371 application of International PCT Application No. PCT/DE01/00752 filed Feb. 28, 2001.

The invention relates to a mixing chamber for producing compressed air foam for fire extinguishing devices for fighting fire having a pressure inlet port, an extinguishing agent inlet and a compressed air form outlet.

Extinguishing foam is used for fighting fire in case of burning liquid and solid materials. A mixture of water and an extinguishing agent is processed via compressed air. Various systems are known in the prior art. For instance, a mixture consisting of water and foam concentrate can be delivered via a rotary pump through a foam discharge pipe wherein production of foam is effected directly at the foam discharge pipe by vacuum mixing of ambient air. U.S. Pat. No. 5,255,747 discloses providing compressed air mixing instead of mixing of ambient air via vacuum. In this case, the amount of air required for producing the foam is added by an air compressor. This provides considerable improvement of the foam quality. The water half-life period required in DIN (German industry standards) 14272 is clearly exceeded and the throwing range of the extinguishing agent jet produced by compressed air foam is increased.

The device known from U.S. Pat. No. 5,255,747 has the disadvantage that a rotary pump driven by a motor and an air compressor have to be provided.

U.S. Pat. No. 5,881,817 discloses a fire suppressant system in which there is no machine-provided conveyance of compressed air foam, for instance conveyance of compressed air foam via a rotary pump. To achieve this, compressed air flow provided by an air supply system is divided wherein one part is directed into a solution tank and another part is directed into a mixing chamber. The solution tank holds a mixture of water and extinguishing agent which is conveyed into the mixing chamber by a partial compressed air flow. The second partial compressed air flow is directed into the mixing chamber. This mixture of air and solution causes a desired foam to form and expand. The mixing chamber known from U.S. Pat. No. 5,881,817 has a cylindrical inner contour wherein at one end the mixture of extinguishing agent and water is fed in and the compressed air is fed in under an angle of 68 degrees relative to the center axis of the cylindrical inner contour and the foamed extinguishing agent flows out at the other end of the cylindrical inner contour.

It is an object of the present invention to provide a mixing chamber for producing compressed air foam for extinguishing devices for fire fighting which is adapted to provide a superior foam quality in a particularly efficient way.

This object is solved by a mixing chamber for producing compressed air foam for extinguishing devices for fire fighting having a compressed air inlet, an extinguishing agent inlet and a compressed air foam outlet wherein the mixing chamber has an inner contour which is tapered towards said compressed air foam outlet. The extinguishing agent preferably consisting of foamed agent and water enters into the mixing chamber through said extinguishing agent inlet. Compressed air provided by a source of compressed air enters into the mixing chamber through said compressed air inlet. The mixture of water and foam agent forms a foam in said mixing chamber due to the addition of compressed air and flows out through said compressed air foam outlet as extinguishing foam. The production of foam is particularly efficient due to the fact that the contour of the mixing chamber tapers towards the compressed air foam outlet. The form of the inner contour of the mixing chamber according to the present invention causes intensive turbulence, particularly a rotation which promotes the mixing process.

The extinguishing foam produced according to the present invention corresponds in quality as wet foam and as dry foam with foam produced by large-scale installations which produce compressed air foam having a water volume portion of more than 1000 liter per minute using expensive measuring and control technique.

Due to the superior efficiency of the foam production in the mixing chamber according to the present invention it is possible to provide particularly compact fire extinguishing devices. The compressed air storage containers can be chosen very small or compressed air production devices already available which are provided as mobile or stationary devices for other purposes can be used.

In a preferred embodiment of the invention, the inner contour of the mixing chamber is substantially conical, the compressed air inlet and the extinguishing agent inlet lead into the bottom of the conical inner contour and the compressed air foam outlet is provided adjacent to or at the tip of the conical inner contour. Other geometrical shapes which have the effect that the mixing chamber tapers towards the compressed air foam outlet are also possible, for instance a semi-spherical shape.

Preferably, the compressed air inlet and the extinguishing agent inlet lead substantially parallel to each other into the mixing chamber. In other words, the ducts or conduits for the compressed air flowing into the mixing chamber and for the extinguishing agent run, at least directly before they enter into the mixing chamber, parallel to each other.

The ratio of the inner diameter of the compressed air inlet or the corresponding compressed air duct, respectively, on the one hand and the inner diameter of the extinguishing agent inlet or the corresponding extinguishing agent duct, respectively, on the other hand is preferably 1 to 3. The inner diameter of the compressed air foam outlet preferably equals the inner diameter of the extinguishing agent inlet.

The mixing chamber is preferably made of materials like plastic, brass or aluminum, i. e. such materials which are corrosion resistant against the foam agent used.

In a preferred embodiment of the invention, a foam controller serving to selectively provide a disturbance element in the passageway of the compressed air foam outlet can be provided behind said compressed air foam outlet. This foam controller can be used to influence the foam quality. For fighting open fire, i. e. if the entire surface of a combustible surface burns, a high water content in the foam is necessary. Due to condensation of the water, energy is withdrawn from the combustion reaction. After the extinguishing effect has taken place, that is after the flames have vanished, post extinguishing work has to be done. This requires a cream like foam having small pores and a low water content. Such dry foam has a long water half-life period and promotes wetting of carbon surfaces. The low water content further results into a longer life period of the extinguishing agent container. As compared with wet foam, at least twice as much and up to five times as much extinguishing agent can be delivered.

The foam controller according to this preferred embodiment of the invention thus provides simple influence of the foam quality. If the foam controller is in the position where a compressed air foam outlet is fully opened, a relatively wet foam is provided having a relatively high water content which enables a large range (throwing distance) and is particularly suited for advanced and intensive fire. If, for instance after the extinguishing effect has taken place and in order to conduct post extinguishing work, a disturbance element is shifted into the free passageway of the compressed air foam by operating the foam controller, dry foam having a low water content is provided. The range is reduced but due to the higher durability of the foam there is an enhanced penetration effect. Penetration of the extinguishing water avoids fresh ignition of burnt solid substances and prevents ignition of not yet burnt substances. The extended allowable operation time of the extinguishing device provided by the lower water content is particularly important for post extinguishing work which is extensive as compared with fighting of open flames.

The foam controller according to present invention can be used with any mixing chamber.

Preferably, the disturbance element is a check element having a plurality of separate passageways. In a particularly preferred embodiment, the disturbance element is made from powdered metal. Powdered metal is particularly suited for producing homogeneous foam bubble structures. Liquids having low surface tension are pressed through the pores of the powdered metals and form very small foam bubbles. The lower the foam bubbles are, the larger is the surface of the liquid. The favorable ratio of mass to surface of the water obtained therewith enhances the efficiency of evaporation and improves the extinguishing ability.

The design of the mixing chamber according to the present invention makes it possible to provide a fire extinguishing device which is optimized concerning volume and weight, which does not need any conveyance means provided by a machine and which can be designed particularly as a retrofit solution for various applications. Possible fields of application include, inter alia, trucks and cargo carriers, ships, submarines as well as work shops and factories. Fire may occur in transport vehicles which is particularly dangerous if such fires occur in tunnels. Small fire extinguishing apparatus usually provided in said vehicles, mainly extinguishers using powder, are not capable of extinguishing an advanced fire. Extinguishing powder does not provide sufficient cooling and the extinguishing agent supply is for instance not sufficient for a burning tire. The fire extinguishing device according to the present invention also enables handling fires which are beyond the initial stage. Trucks are provided with compressed air brake systems. Air compressors of vehicles having an allowable overall weight of, for instance, 16,000 kg are sufficiently effective to operate the mixing chamber of the present kind. Further fields of applications are transports of dangerous goods, particularly through tunnels, military convoys and armoured cars. Also vehicles and machines in the field of construction, agriculture or mining can be efficiently made safer by a fire extinguishing device according to the present invention if such vehicles and machines have sufficiently powerful air compressors.

Ships and submarines are also provided with compressor systems. Accordingly, also for such water vehicles it is an advantage to have an efficient extinguishing system which is small in size. Retrofitting with a fire extinguishing device of the present invention is possible at any time.

Finally, most commercial operations and factories have pneumatic control using compressed air and compressed air operated tools. Usually, the compressor systems that are used have sufficient air volume flow performance to operate a fire extinguishing device of the present invention. Specifically in operations and factories processing plastic in which thermoplastic substances are processed which only can be extinguished by a foam extinguishing method security against fire can be provided in a simple manner by a fire extinguishing device of the present invention.

The fire extinguishing device according to the present invention is small in size, can be retrofitted at any time and can be easily mounted, has a low weight since only an extinguishing agent supply has to be provided but no separate compressed air source, is considerably more effective than regular water, particularly if there are fires in connection with plastic or liquids and, additionally, prevents damages caused by water.

In the following description, the invention is further explained in connection with preferred embodiments making reference to the drawing in which FIG. 1 is a schematic depiction of an embodiment of a fire extinguishing device according to the present invention;

Figure 2:
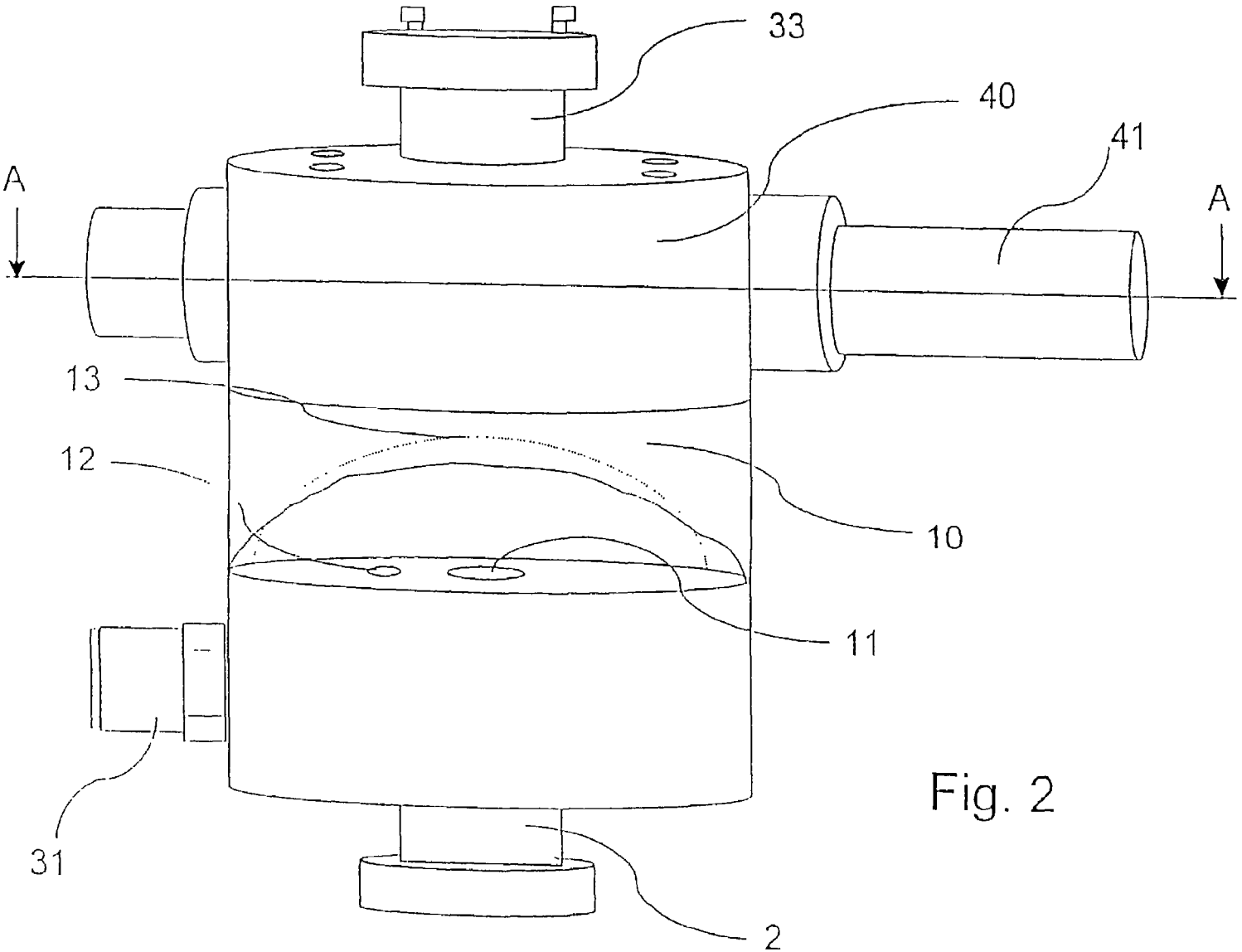
FIG. 2 is a schematic perspective representation of a first embodiment of a mixing chamber according to the present invention having a foam controller.
Figure 3:
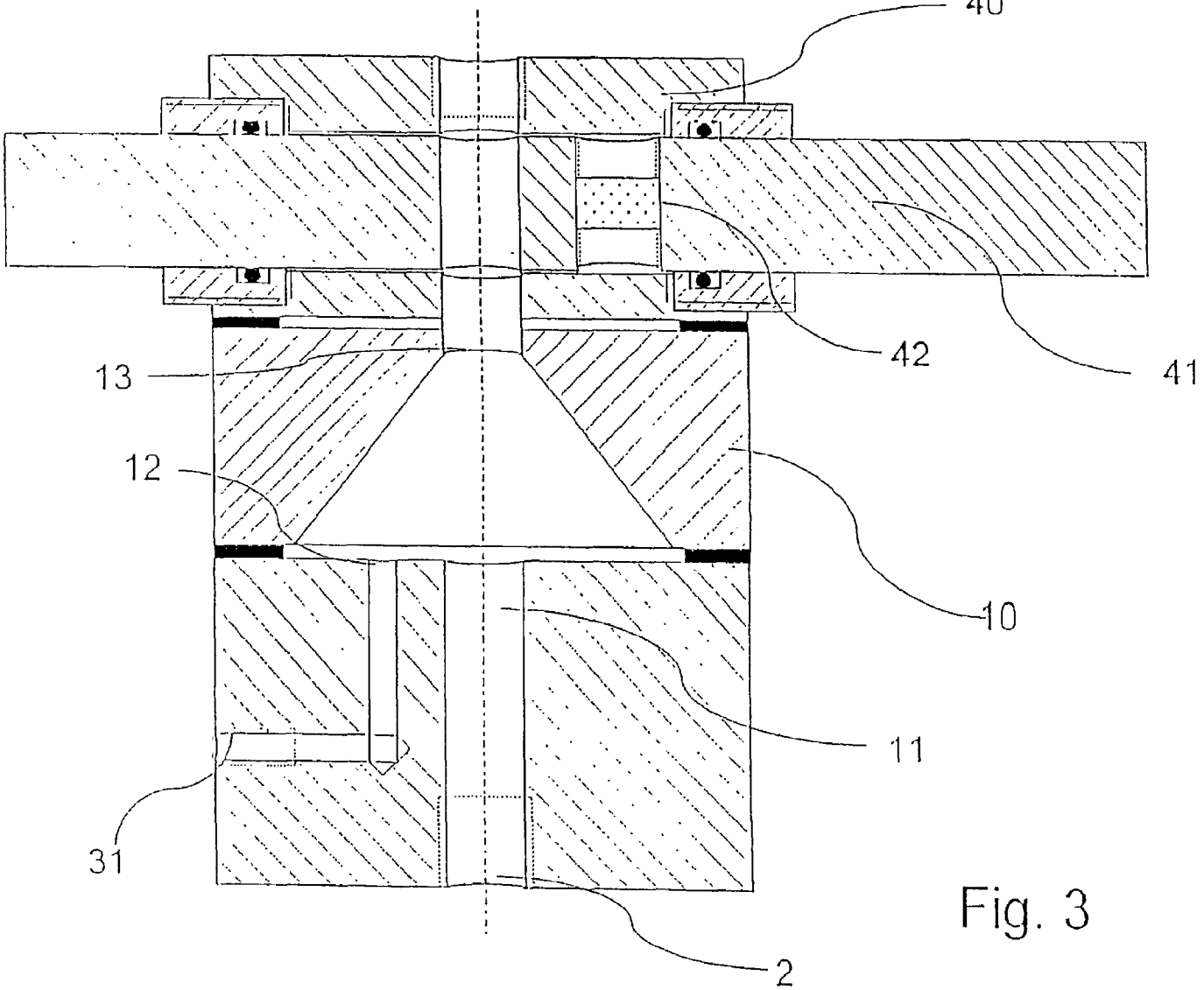
FIG. 3 is a sectional view of a second embodiment of a mixing chamber according to the present invention having a foam controller.
Figure 3A:
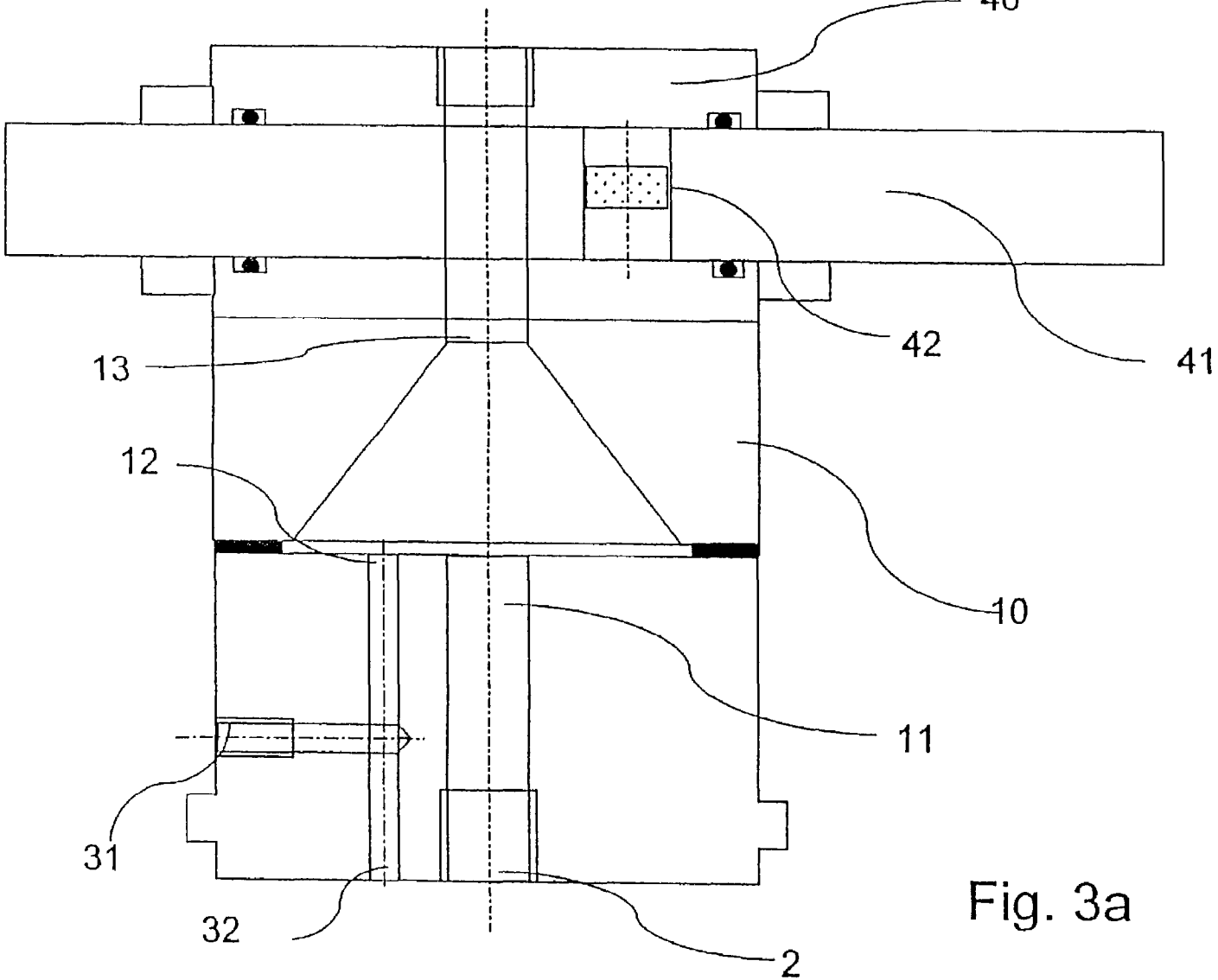
Figure 4:
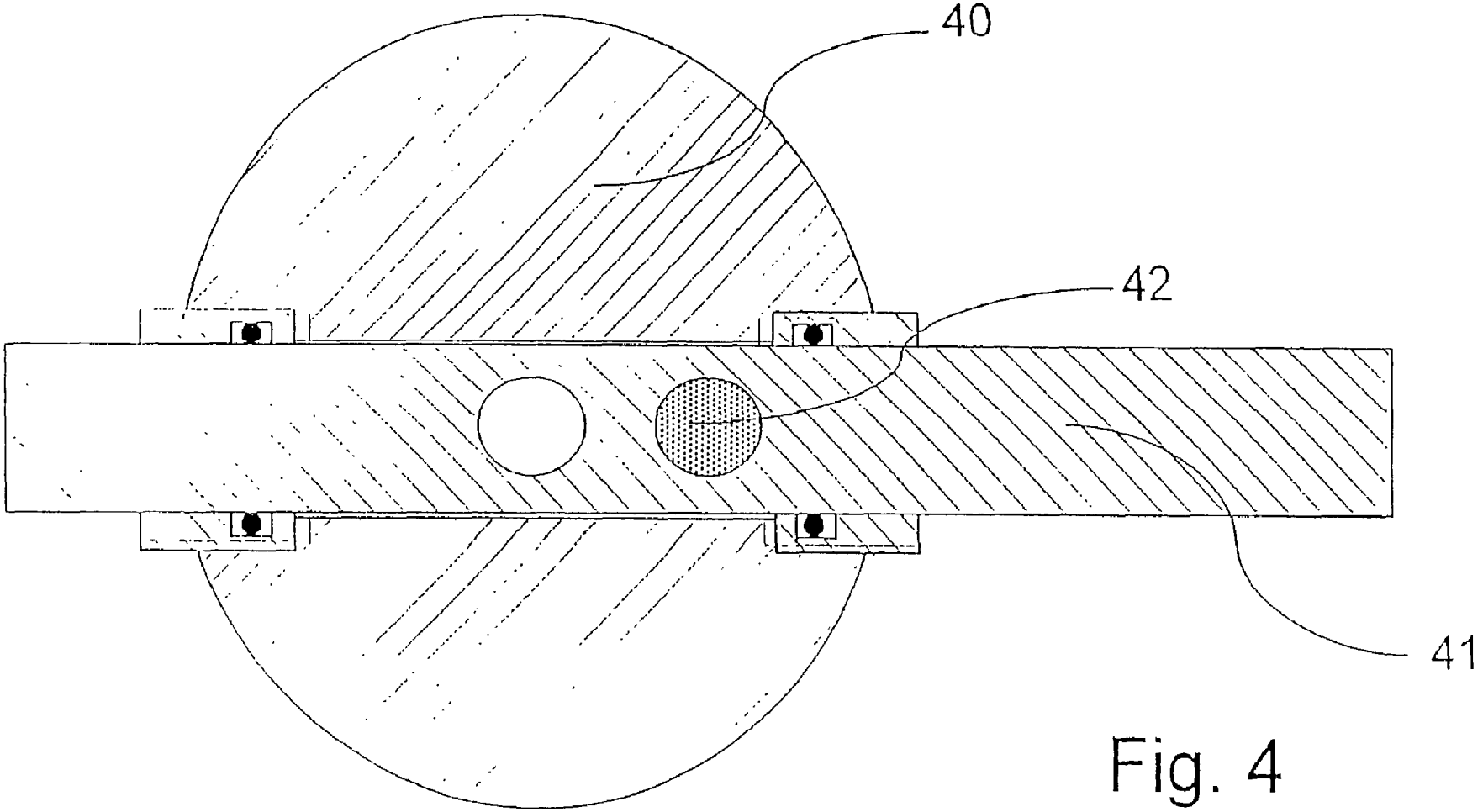

FIG. 3*a* is a sectional view of a third embodiment of a mixing chamber according to the present invention having a foam controller and integrated separation of compressed air volume flow;

FIG. 4 is a sectional view along line A-A in FIG. 2; and

Figure 5:
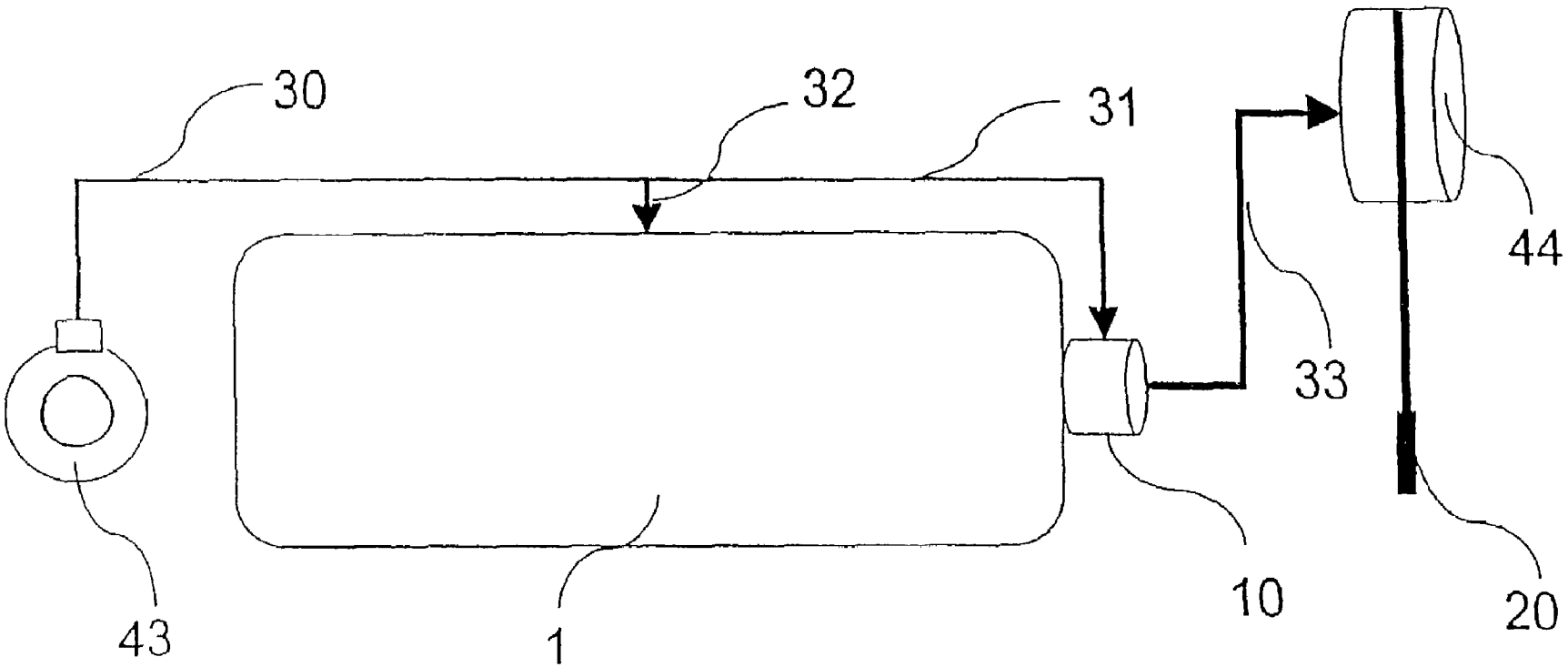

FIG. 5 is a schematic representation of an extinguishing device for stationary retrofit in a truck.

Unless indicated otherwise, identical reference numbers are used in the figures for corresponding elements.

Figure 1:
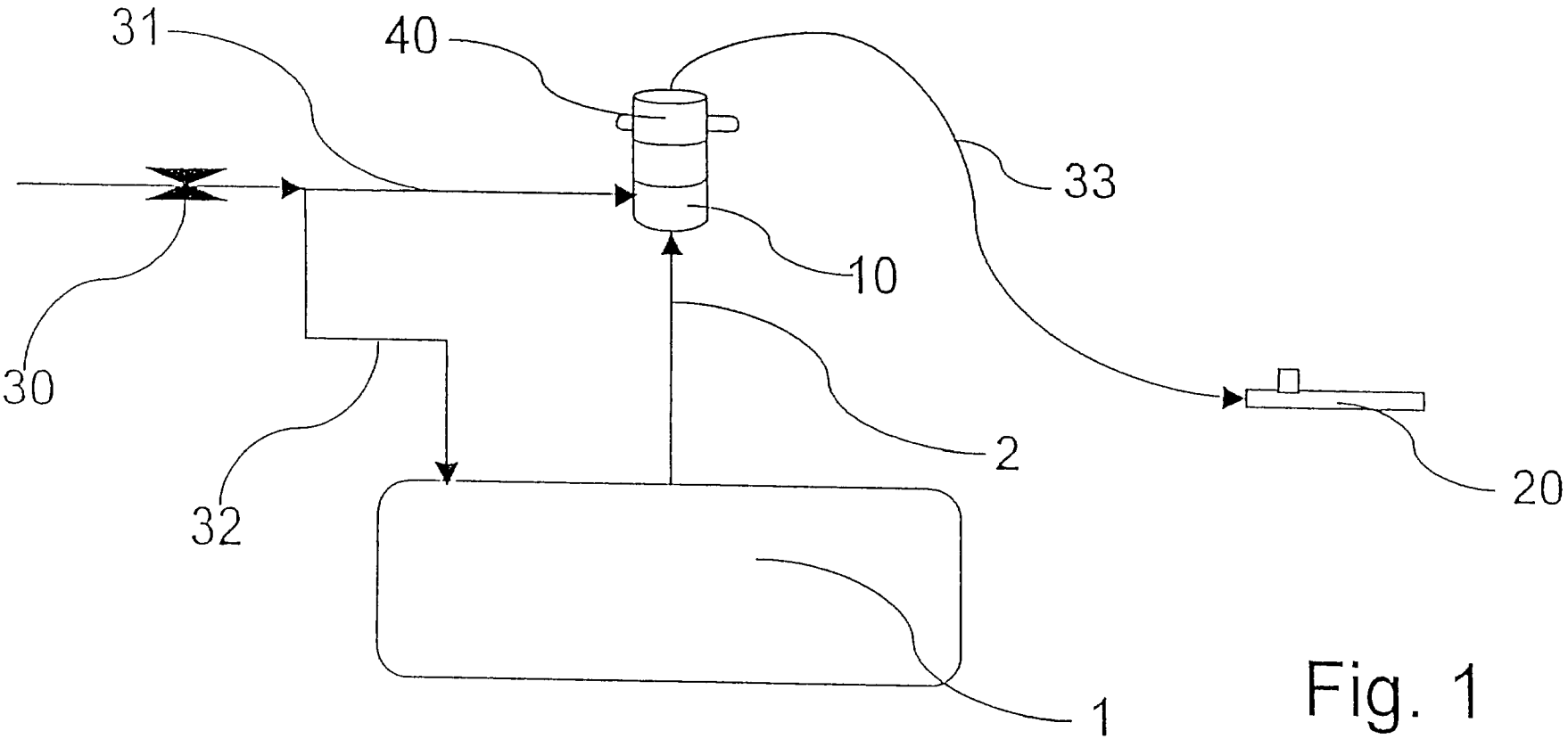

FIG. 1 schematically shows a fire extinguishing device having an extinguishing agent container 1, a mixing chamber 10 and a nozzle 20 which can be checked. The extinguishing agent container 1 is adapted to contain water and a foam agent. The extinguishing agent container 1 is connected with the mixing chamber 10 via an extinguishing agent duct 2. The extinguishing agent duct 2 is a commercially available, dimensionally stable pressure pipe and communicates via an extinguishing agent inlet 11 with the interior of the mixing chamber 10. Preferably, a standpipe or feed pipe (not shown) provided in the extinguishing agent container 1 has the same inner diameter as the extinguishing agent duct 2 which in turn has the same inner diameter as the extinguishing agent inlet 11.

A compressed air source 30 not shown in detail, which for instance can be a tank filled with compressed air or a compressor driven by a motor, is connected with the mixing chamber 10 via a first compressed air duct 31 and with the extinguishing agent container 1 via a second compressed air duct 32. The compressed air ducts 31 and 32 can be commercially available, preferably dimensionally stable pressure pipes which can be provided with commercially available quick exchange connecting elements. The first compressed air duct 31 communicates via a compressed air inlet 12 with the interior of the mixing chamber 10. Preferably, the inner diameter of the compressed air duct 31 should be equal to the inner diameter of the compressed air duct 31.

The nozzle 20 which can have an on/off check valve and preferably has a smooth inner surface, since additional disturbance elements at this position could destroy the foam bubble structures, is connected with the mixing chamber via a conventional pipe 33. The pipe 33 communicates with the mixing chamber via a compressed air foam outlet 13.

A first embodiment of the mixing chamber 10 is schematically shown in FIG. 2 in a perspective, partially sectioned view. In this embodiment the mixing chamber 10 has a hemispherical inner contour wherein the extinguishing agent inlet 11 and the compressed air inlet 12 are at the flat side of the hemisphere and the compressed air foam outlet 13 is disposed opposite to the flat side of the hemisphere at the zenith thereof.

A foam controller 40 is integrally formed with the mixing chamber 10. The flow direction of the extinguishing agent consisting of water and foam agent in the extinguishing agent duct 2 and the flow direction of the extinguishing foam in pipe 33 are indicated by arrows in FIG. 1. A switch element 41 of the foam controller 40 can be shifted in a direction perpendicular to the flow direction.

FIG. 3 is a sectional view of another embodiment of the mixing chamber 10. In this embodiment, the inner contour of the mixing chamber is conical wherein the extinguishing agent inlet 11 and the compressed air inlet 12 are disposed at the flat side of the cone and the compressed air foam outlet 13 is disposed at the tip of the cone. The extinguishing agent inlet 11 is directly opposite to the compressed air foam outlet 13. The diameter of the compressed air foam outlet 13 is the same as the diameter of the extinguishing agent inlet 11. The compressed air inlet 12 and the extinguishing agent inlet 11 or, as the case may be, the corresponding duct portions directly in front thereof extend in parallel to each other. The diameter of the extinguishing agent inlet 11 is three times as large as the diameter of the compressed air inlet 12.

If, for instance, the diameter of the extinguishing agent duct 2 and the extinguishing agent inlet 11 is 6 mm, the diameter of the first compressed air duct 31 and the compressed air inlet 12 is 2 mm. For operation of the fire extinguishing device described here with an air compressor of a truck it has been found appropriate that the inner diameter of the extinguishing agent duct 2 as well as of the extinguishing agent inlet 11 is 12 mm and the inner diameter of the first compressed air duct 31 and the compressed air inlet 12 is 4 mm.

FIG. 3 also shows the switch element 41 of the foam controller 40.

FIG. 4 is a sectional view of the foam controller 40 and the switch element 41. In the position as shown in FIGS. 3 and 4, the switch element 41 completely opens the passageway of the compressed air foam outlet. In this position of the foam controller a relatively wet foam is produced upon operation of the fire extinguishing device which relatively wet foam has a wide range, i. e. large throwing distance due to its relatively high water content and which is particularly suited for advanced, intensive fire. If the switch element 41 as shown in FIG. 3 or 4, respectively, is shifted to the left side, a disturbance element 42 gets into the passageway of the compressed air foam outlet. In this position a relatively dry foam having a lower water content is produced upon operation of the fire extinguishing device which dry foam is more appropriate for post extinguishing work.

The disturbance element 42 is preferably made of powdered metal. The switch element 41 is supported in a correspondingly formed bore of the foam controller 40 and can be shifted in perpendicular direction with respect to the flow direction of the extinguishing foam. It can take the two definite positions explained above.

In the following, the function and operation of the fire extinguishing device, the mixing chamber 10 and the foam controller 40 are explained.

A connection device which is not shown in detail is connected with a compressed air source 30. A partial flow of the compressed air provided by the compressed air source 30 flows via the second compressed air duct 32 into the extinguishing agent container 1 and presses an extinguishing agent consisting of water and a foam agent through the extinguishing agent duct 2 and the extinguishing agent inlet 11 into the mixing chamber 10. The remaining partial flow of the compressed air source 30 flows through the first compressed air duct 31 and the compressed air inlet 12 into the mixing chamber and causes, particularly due to a rotational movement, an intensive swirl of the extinguishing agent which leads to the formation of foam. The foamed extinguishing agent flows through the compressed air foam outlet 13 out of the mixing chamber as extinguishing foam. If the switch element 41 of the foam controller 30 is in the position for wet foam in which the passageway is completely cleared, the extinguishing foam passes through the pipe 33 and the nozzle 20 into the ambience.

In an embodiment where the compressed air source 30 is a commercially available air compressor of a truck, where the inner diameter of the extinguishing agent duct 2 and the compressed air foam outlet 13 was 12 mm and where the diameter of the first compressed air duct 31 and the compressed air inlet 12 was 4 mm, a range of approximately 12 m could be reached using a pipe having a length of 10 m. The water content in case of wet foam was about 30 liter per minute. The range could be increased to about 16 m with a water content of 25 liter per minute by using an optimized nozzle. It has proved particularly advantageous to use a specific nozzle which is an extinguishing pistol for a truck extinguisher which is commercially available by Karasto Armaturenfabrik, Oehler GmbH, 70734 Fellbach, Germany under the trade name "Gieβbrause 521 PL SB G 3/4 Zoll mit Vollstrahldüse 520 S AG G 3/4 Zoll".

It will be understood by a person skilled in the art that the size of the bores as well as the pressure ratios determine the volume flow. If a compressed air tank is used, the compressed air supply has to be such that it is sufficient for pressing out the entire extinguishing agent supply. If a compressed air generator is used, it is understood that sufficient compressed air can be provided continuously. Depending on the purpose, the air volume flow can be about 6 liter per second at 8 to 10 bar pressure. If smaller devices are used, a smaller air volume flow is possible at the same pressure.

Operation of the extinguishing device as explained above is particularly useful for fighting an intensive fire. For subsequent post extinguishing work the switch element 41 in the foam controller 40 is shifted so that the disturbance element 42 enters into the passageway behind the compressed air foam outlet 13. This influences the foam quality, the water content of the extinguishing foam and the time of deliverance of foam agent. A cream like foam having fine pores and a low water content is produced. Due to the low water content, the operation period of the fire extinguishing device can be extended. As compared with the position for wet foam, the time during which extinguishing agent can be delivered can be doubled or under certain circumstances, can be extended five times in the position for dry foam as compared with the position for wet foam.

FIG. 3*a* is a sectional view of an embodiment of the mixing chamber according to the present invention having a foam controller and an integrated separation of the compressed air volume flow. Such embodiment is particularly suited for a portable fire extinguisher. The overall mass of a portable fire extinguisher is limited for reasons of easy operation. For instance, in Europe, portable fire extinguishers have to comply with the requirements of norm European EN 3 according to which the total mass of a portable fire extinguisher is limited to 20 kg. The extinguishing agent content of a foam extinguisher is limited to a maximum of 9 liters. The total volume as well as the total mass for a portable fire extinguisher are therefore to be kept as small as possible.

The embodiment of the mixing chamber according to the present invention as shown in FIG. 3*a* in the form of corresponding component can be put on a commercially available foam extinguisher such that the filler opening for filling in the foam of the extinguisher is closed by the mixing chamber or the corresponding component comprising the mixing chamber, respectively. In order to keep the system simple and compact it is possible that the splitting of the compressed air volume flow in a first partial flow into the interior of the mixing chamber and a second partial flow into the extinguishing agent container 1 is integrated in the mixing chamber 10 or the corresponding component comprising the mixing chamber, respectively. As can be seen from FIG. 3*a,* a compressed air duct 31 which can be connected to a compressed air source 30 leads into the part of the mixing chamber 10 or the corresponding component comprising the mixing chamber respectively, which is mounted to the foam extinguisher. In the interior of this component the compressed air flow is divided into a first part which communicates with the compressed air inlet 12 and a second part which communicates via the compressed air duct 32 with the filler opening of the foam extinguisher. The inner diameter of the compressed air duct having the reference sign 32 in FIG. 3*a* is preferably equal to the diameter of the compressed air inlet 12.

If a commercially available portable foam extinguisher is used, the required compressed air can be provided for instance by a compressed air tank having a volume of 1 liter and a charge pressure of 200 bar. Such a portable fire extinguisher has an operation time of 40 seconds and a range of 10 m in the wet mode. In the dry mode the time of operation is 80 seconds.

The embodiment according to FIG. 3*a* as explained above has a foam controller 40. This kind of fire extinguisher is intended for professional application by the fire department. European norm EN 3 mentioned above allows only one switching operation for activating a portable fire extinguisher. Accordingly, for such application a foam controller has to be omitted.

FIG. 5 shows a schematical representation of an extinguishing device for stationary retrofit mounting at a truck using the mixing chamber 10 of the present invention.

Particularly if hazardous freight is transported, burning tires, fires in the engine compartment or fires due to accidents, for instance as a result of a crash, can lead to enormous damages. The fire extinguishing device as shown in FIG. 5 is an effective means for fighting fire and is even adapted to be retrofitted.

A commercially available extinguishing agent container 1 is mounted at a suitable position of a truck, for instance at the lower frame (not shown). The capacity of the extinguishing agent container should be preferably at least 40 liters. In this embodiment, a compressed air tank 43 having a volume of 4 liters and a charge pressure of 200 bar is provided by compressed air source 30. The mixing chamber 10 or the corresponding component comprising the mixing chamber 10, respectively, is directly mounted at the extinguishing agent container 1. The compressed air duct from the compressed air source 30, i. e. the compressed air tank 43, is split so that compressed air is led into the mixing chamber 10 via the compressed air duct 31 and compressed air is led to the extinguishing agent container 1 via compressed air duct 32. The compressed air ducts 31 and 32 preferably have the same inner diameter.

The mixing chamber 10 is coupled to a reel 44 via a conveyor duct 33. On said reel 44 there is a hose having a foam pistol 20. The hose can have a length of, for instance, 20 m.

The extinguishing device as described above has an operation period of 110 seconds and a range of 16 m. If necessary, the operation period can be extended by mounting a bigger extinguishing agent container and bigger compressed air tanks. For professional use by the fire department, a foam controller can be provided.

The invention claimed is:

1. A mixing chamber for producing compressed foam for an extinguishing device for fire fighting, the mixing chamber defining a contour, the mixing chamber comprising:

a compressed air inlet communicating with a compressed air duct connected to a compressed air source;

an extinguishing agent inlet connected to an extinguishing agent container;

a compressed air foam outlet, the contour of said mixing chamber tapering towards said compressed air foam outlet; and a foam controller behind said compressed air foam outlet, said foam controller selectively providing a disturbance element in a passageway defined by said compressed air foam outlet, said foam controller comprises a switch element which can be shifted between first and second positions transverse to a flow direction of the compressed air foam, and said switch element selectively keeps said passageway defined by a duct connected to said compressed air foam outlet free when in the first position, and provides said disturbance element in said duct when in the second position.

2. A mixing chamber for producing compressed foam for an extinguishing device for fire fighting, the mixing chamber defining a contour, the mixing chamber comprising:

a compressed air inlet communicating with a compressed air duct connected to a compressed air source;

an extinguishing agent inlet connected to an extinguishing agent container; and a compressed air foam outlet, the contour of said mixing chamber tapering towards said compressed air foam outlet; and a foam controller behind said compressed air foam outlet, said foam controller selectively providing a disturbance element in a passageway defined by said compressed air foam outlet, said disturbance element defining a plurality of passageways.

3. A fire extinguishing device comprising:

an extinguishing agent container;

a compressed air source;

a connecting duct connected with said compressed air source;

a mixing chamber defining a contour, the mixing chamber comprising:

a compressed air inlet connected with said compressed air source;

an extinguishing agent inlet connected with said extinguishing agent container; and a compressed air foam outlet, and the contour of said mixing chamber tapering towards said compressed air foam outlet;

said connecting duct comprising a first compressed air duct connected to said mixing chamber and a second compressed air duct connected to said extinguishing agent container; and a component comprising said mixing chamber is directly mounted to said extinguishing agent container, said component is connectable to said compressed air source via a single pressure pipe, and a compressed air flow in said first compressed air duct and said second compressed air duct is divided by bores in said component.

4. A fire extinguishing device comprising:
an extinguishing agent container;
a compressed air source;
a mixing chamber defining a substantially conical contour to create turbulence, said contour defining a bottom portion, said contour tapering toward a tip portion opposite said bottom portion, the mixing chamber comprising:
a compressed air inlet connected with said compressed air source to introduce compressed air into the bottom portion of said contour;
an extinguishing agent inlet connected with said extinguishing agent container to introduce extinguishing agent into the bottom portion of said contour;
the compressed air and the extinguishing agent undergoing turbulent mixing to form a compressed air foam when the compressed air and extinguishing agent are introduced into the mixing chamber; and
a compressed air foam outlet adjacent the tip portion to exhaust said compressed air foam from said mixing chamber; and
a connecting duct connected with said compressed air source, said connecting duct comprising a first compressed air duct connected to said mixing chamber and a second compressed air duct connected to said extinguishing agent container;
wherein a component comprising said mixing chamber is directly mounted to said extinguishing agent container and wherein said mixing chamber is connected to said compressed air source via a single pressure pipe, and a compressed air flow in said first compressed air duct and said second compressed air duct is divided by bores in the component comprising said mixing chamber.

5. The fire extinguishing device as claimed in claim 4, wherein said first compressed duct is connected to said mixing chamber and said second compressed air duct is connected to said extinguishing agent container have a same diameter.

6. The fire extinguishing device as claimed in claim 4, wherein said extinguishing agent container comprises a standpipe which is connected to said mixing chamber via an extinguishing agent duct, wherein an inner diameter of said standpipe is equal to an inner diameter of said extinguishing agent duct and to an inner diameter of said extinguishing agent inlet.

7. The fire extinguishing device as claimed in claim 4, for use as a portable fire extinguishing device, having an overall weight of not more than 20 kg, wherein said extinguishing agent container has a volume of not more than 9 liters and said compressed air source is a compressed air tank having a volume of 1 liter and a charge pressure of 200 bar.

8. The fire extinguishing device as claimed in claim 4, configured for use as a stationary fire extinguishing device which can be retrofitted, wherein said extinguishing agent container has a volume of at least 40 liters and said compressed air source is a compressed air tank having a volume of at least 4 liters and a charge pressure of 200 bar.

9. The fire extinguishing device as claimed in claim 4, wherein a ratio of an inner diameter of said compressed air inlet to an inner diameter of said extinguishing agent inlet is 1 to 3.

10. The fire extinguishing device as claimed in claim 4, wherein an inner diameter of said extinguishing agent inlet is equal to an inner diameter of said compressed air foam outlet.

11. A fire extinguishing device comprising:
an extinguishing agent container;
a compressed air source;
a mixing chamber defining a substantially conical contour to create turbulence, said contour defining a bottom portion, said contour tapering toward a tip portion opposite said bottom portion, the mixing chamber comprising:
a compressed air inlet connected with said compressed air source to introduce compressed air into the bottom portion of said contour;
an extinguishing agent inlet connected with said extinguishing agent container to introduce extinguishing agent into the bottom portion of said contour;
the compressed air and the extinguishing agent undergoing turbulent mixing to form a compressed air foam when the compressed air and extinguishing agent are introduced into the mixing chamber;
a compressed air foam outlet adjacent the tip portion to exhaust said compressed air foam from said mixing chamber; and
a foam controller behind said compressed air foam outlet, said foam controller selectively providing a disturbance element in a passageway defined by said compressed air foam outlet, wherein said foam controller comprises a switch element which can be shifted between first and second positions transverse to a flow direction of the compressed air foam, and said switch element selectively keeps said passageway defined by a duct connected to said compressed air foam outlet free when in the first position, and provides said disturbance element in said duct when in the second position.

12. The fire extinguishing device as claimed in claim 11, wherein said disturbance element defines a plurality of passageways.

13. A fire extinguishing device comprising:
an extinguishing agent container;
a compressed air source;
a mixing chamber defining a substantially conical contour to create turbulence, said contour defining a bottom portion, said contour tapering toward a tip portion opposite said bottom portion, the mixing chamber comprising:
a compressed air inlet connected with said compressed air source to introduce compressed air into the bottom portion of said contour;
an extinguishing agent inlet connected with said extinguishing agent container to introduce extinguishing agent into the bottom portion of said contour;
the compressed air and the extinguishing agent undergoing turbulent mixing to form a compressed air foam when the compressed air and extinguishing agent are introduced into the mixing chamber;
a compressed air foam outlet adjacent the tip portion to exhaust said compressed air foam from said mixing chamber; and
a foam controller behind said compressed air foam outlet, such foam controller selectively providing a disturbance element in a passageway defined by said compressed air foam outlet, wherein said disturbance element defines a plurality of passageways.

* * * * *

UNITED STATES PATENT AND TRADEMARK OFFICE

CERTIFICATE OF CORRECTION

PATENT NO. : 7,458,427 B2
APPLICATION NO. : 10/204985
DATED : December 2, 2008
INVENTOR(S) : Braun et al.

It is certified that error appears in the above-identified patent and that said Letters Patent is hereby corrected as shown below:

Title Page item 56
In the References Cited, the following reference is included:

DE PS 687 926 2/1940

In the claims, Claim 11, lines 28-32 should read:

said switch element selectively keeps the passageway of a duct connected to said compressed air foam outlet free when in the first position, and provides a disturbance element in said passageway of said duct when in the second position.

Signed and Sealed this

Twenty-eighth Day of April, 2009

John Doll

JOHN DOLL
*Acting Director of the United States Patent and Trademark Office*

UNITED STATES PATENT AND TRADEMARK OFFICE

CERTIFICATE OF CORRECTION

PATENT NO. : 7,458,427 B2
APPLICATION NO. : 10/204985
DATED : December 2, 2008
INVENTOR(S) : Braun et al.

It is certified that error appears in the above-identified patent and that said Letters Patent is hereby corrected as shown below:

Title Page item 56
In the References Cited, the following reference is included:

DE PS 687 926 2/1940

In the claims, Column 10, Claim 11, lines 28-32 should read:

said switch element selectively keeps the passageway of a duct connected to said compressed air foam outlet free when in the first position, and provides a disturbance element in said passageway of said duct when in the second position.

This certificate supersedes the Certificate of Correction issued April 28, 2009.

Signed and Sealed this

Nineteenth Day of May, 2009

John Doll

JOHN DOLL
*Acting Director of the United States Patent and Trademark Office*